United States Patent [19]

Inglis

[11] Patent Number: 4,588,145

[45] Date of Patent: May 13, 1986

[54] MISSILE TAIL FIN ASSEMBLY

[75] Inventor: Ronald T. Inglis, Laguna Beach, Calif.

[73] Assignee: General Dynamics Pomona Division, Pomona, Calif.

[21] Appl. No.: 523,472

[22] Filed: Aug. 15, 1983

[51] Int. Cl.[4] ..... F42B 15/02

[52] U.S. Cl. ..... 244/3.24; 244/3.23

[58] Field of Search ..... 244/3.1, 3.23–3.3

[56] References Cited

U.S. PATENT DOCUMENTS

| | | | |
|---|---|---|---|
| 2,152,029 | 3/1929 | Cone . | |
| 2,858,765 | 11/1958 | Startzell | 244/3.29 |
| 3,117,520 | 1/1964 | Kerr et al. . | |
| 3,223,034 | 12/1965 | Robertson . | |
| 3,695,556 | 10/1972 | Gauzza | 244/3.28 |
| 3,964,696 | 6/1976 | Orzechowski | 244/3.29 |
| 4,024,998 | 5/1977 | Rabinow et al. . | |

*Primary Examiner*—Harold J. Tudor

*Attorney, Agent, or Firm*—Henry M. Bissell; Edward B. Johnson

[57] ABSTRACT

An improved missile tail fin assembly. The missile utilizes four tail fin assemblies, each assembly comprising a fitting having three locking portions, each of which comprises a gudgeon having a pair of locking teeth, and a fin having mating recesses for the locking portions. A portion of the material associated with recesses of the two forward locks of each fin is removed, leaving clearances which permit limited rotation about the fin pivot axis in one direction only. When the fin is loaded in a direction to produce clockwise torque, all three locks which form the lock assembly are loaded approximately equal and this locates the elastic axis of the tail lock approximately just aft of the center of pressure which produces a small increase in cant angle with load. When the tail fin is loaded in the direction to produce a counterclockwise torque, the aft lock of the assembly will take all the torque. This moves the elastic axis further aft thus producing a larger increase in cant angle with load. The difference of these two changes in cant angle will be a net torque in the counterclockwise direction. When the deflection at the two forward lock positions reaches the clearance limit, all three locks will pick up the load and the surface will have the same stiffness as an unmodified tail fin.

12 Claims, 5 Drawing Figures

MISSILE TAIL FIN ASSEMBLY

The Government has rights in this invention pursuant to Contract No. DAAK40-77-C-0122, awarded by the United States Army.

BACKGROUND OF THE INVENTION

1. Field of the Invention

This invention relates to missile aerodynamic surfaces and, more particularly, to providing an improved missile tail fin assembly for developing specific control of missile roll rate under certain flight conditions.

2. Description of the Prior Art

As is well known in the art, flight stability can be provided to a missile launched from a launching device, such as a rocket tube, by imparting a rolling motion thereto, normally in the counterclockwise (looking forward) direction. If the missile rolls too fast, guidance phasing errors can develop. If the missile rolls too slowly, roll-pitch coupling, in addition to phasing errors, can develop. With large angles of attack, however, the roll rate of the missile inherently slows because of aerodynamic damping which increases with increased angles of attack. What is desired is a system that compensates for all or some of the decay and also has minimal impact on cost, fin strength, flutter and aerodynamics associated with the fin assembly.

Most tube launched missiles have tail fin assemblies mounted to the reat of the missile body to provide missile stability during flight. The fins of the assembly are folded over in a manner such that the fins do not interfere with the launching. After launch, the fins are caused to extend outward by unfolding to a normal operating position. Prior art systems have been devised which allow the fins to be mounted to the missile body simply and securely. For example, U.S. Pat. No. 3,117,520 discloses a missile having a fitting formed therein in which a fin can be inserted. The fitting has spaced pins formed therein and the corresponding fin has a number of notches which correspond to the location of the spaced pins. The fitting also has a tapered slot arrangement such that when the fin is inserted into the notches and forced to the rear of the missile, a more secure mating between the fitting and the fin is provided. A locking device is also provided to further secure the fin assembly to the missile.

From the above discussion it can be seen that it would be very efficient from a cost standpoint if a tail fin assembly could be provided that both minimizes the roll rate decay problem described hereinabove and, in addition, functions to securely lock the fin assembly to the missile in the desired attitude for operational control. The present invention involves the modification of an existing missile tail fin assembly to achieve such a result.

SUMMARY OF THE PRESENT INVENTION

In brief, arrangements in accordance with the present invention comprise an improved missile tail fin assembly. In one embodiment, the missile utilizes a number of tail fin assemblies mounted on a collar which is attached to the missile. Each assembly comprises a fitting having two or more locking details, each of which comprises a single gudgeon having a pair of locking teeth, and a fin having a pair of mating recesses in the associated portion thereof. A portion of the material associated with recesses of the forward locks for each fin is removed. When the fin is loaded in a direction to produce clockwise torque about the fin mounting axis (which is the case for the left-hand fin with the missile in a nose-up attitude or for the right-hand fin with the missile in a nose-down attitude), all of the locks which form the lock assembly are loaded approximately equally and this locates the elastic axis of the tail fin approximately just aft of the center of pressure, which produces a negligible distortion of the fin and therefore only a slight increase in cant angle with load. However, when a tail fin is loaded in the direction to produce a counterclockwise torque about its mounting axis, the aft lock of the assembly takes all of the torque because of the clearances present in the forward locks. This moves the elastic axis further aft, thus permitting a larger distortion of the fin and a substantial increase in cant angle with load. The difference of these resulting cant angles for the two horizontal fins develops a net torque in the counterclockwise direction about the missile axis, thus tending to compensate for the tendency to decrease the roll rate at increased angles of attack. When the deflection at the forward lock positions of the fin undergoing distortion due to aerodynamic loading reaches the point where all of the clearances are taken up, all of the locks pick up the load and the fin will have the same stiffness as an unmodified tail fin. Thus the fin is adequately supported by the locks in the extended position, regardless of the direction of the aerodynamic side load on the fin. As the missile rolls, each fin in turn comes into a position which permits the distortion of the fin, as just described, to develop an increased cant angle which produces aerodynamic forces reinforcing the roll rate of the missile, regardless of whether the nose of the missile is high or low relative to the missile path. Because of the clearances which are provided, the fins automatically discriminate between the distortion which occurs between right-hand and left-hand fin positions and depending on whether the angle of attack is positive or negative. Moreover, within the range of distortion which is permitted by the clearances in the forward lock positions, the degree of roll rate decay compensation is dependent upon the magnitude of the angle of attack, thereby automatically adjusting the degree of compensation to the tendency for roll rate decay which is also related to the magnitude of the attack angle.

BRIEF DESCRIPTION OF THE DRAWING

A better understanding of the present invention may be had from a consideration of the following detailed description, taken in conjunction with the accompanying drawings in which.

DESCRIPTION OF THE PREFERRED EMBODIMENT

Figure 1:
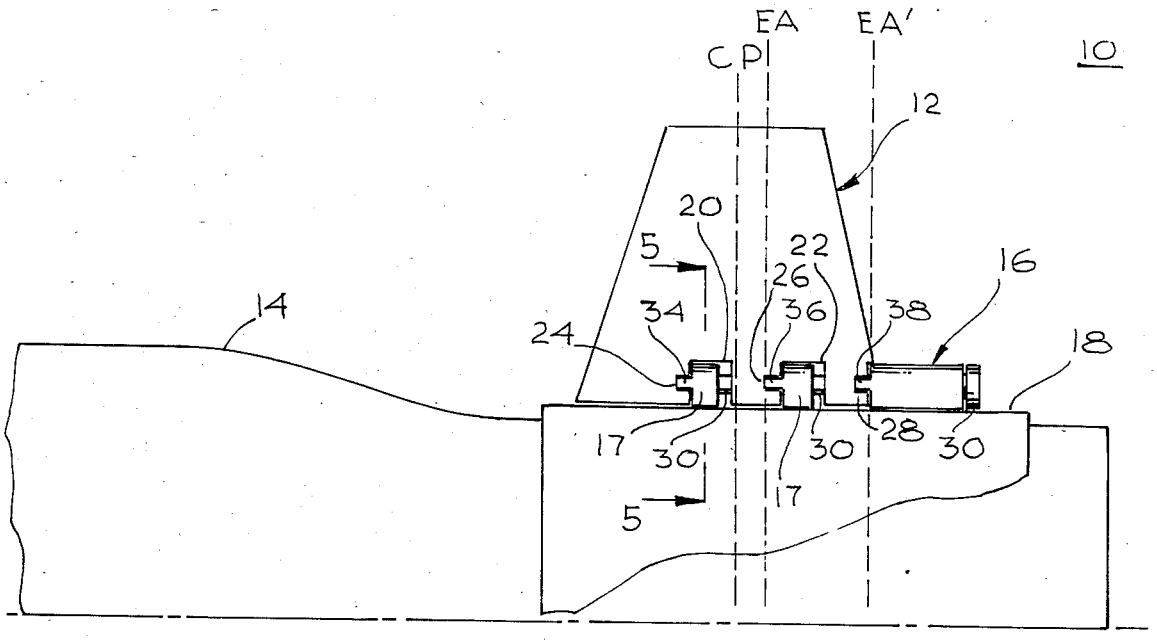
FIG. 1 is a partial side elevational view of a typical missile fin assembly of the present invention.

Referring to FIG. 1, a side elevational view of a typical missile fin assembly 10 in accordance with the teachings of the present invention is illustrated. The fin assembly 10 comprises a fin 12 (although only one fin assembly is shown, there will be preferably two or more such fin assemblies positioned at the aft portion of a missile 14), a locking mechanism 16 and a collar 18 mounted to the aft, or rear, of missile 14. As will be described in more detail with reference to FIG. 2, two notched areas 20 and 22, each including a horizontal slot area 24 and 26, respectively, and a third horizontal slot area 28 are formed in fin 12. Fin 12 is attached in a pivotable, or hinged, mounting on hinge pin 30 to collar 18 which in turn is mounted on the tail of missile 14. Fin 12 folds in against collar 18 so that missile 14 can be loaded into a launch tube. When the missile is fired, centrifugal force, due to the roll of the missile, or a torsion spring causes each fin 12 to flip outward, at which time a spring, mounted coaxially with hinge pin 30 within the member 16, drives the fin 12 rearward so that slots 24, 26 and 28 engage locking teeth 34, 36 and 38, respectively, on the gudgeons 17 of collar 18.

The tail fin 12 is shown provided with three locking portions, or locks, each of which comprises a single gudgeon having a pair of locking teeth (on the collar side of the mounting) and a pair of mating recesses, or slots, in the associated portion of tail fin 12.

The configuration of the tail fin 12 relative to the three locks is normally such that the center of pressure (CP) is slightly forward of the elastic, or twist, axis (EA) of the fin and thus produces a small increase in cant angle as the pressure of the aerodynamic forces increases (as the missile angle of attack increases). The normal direction of roll imparted to missile 14 is counterclockwise (CCW) looking from aft to forward and the design roll rate is about 12 r.p.s., the acceptable band or range of roll rate being limited. If missile 14 rolls too fast, phasing errors may occur. If it rolls too slowly, roll-pitch coupling, in addition to phasing errors, may develop. With large angles of attack, the roll rate of the missile inherently slows because of aerodynamic damping which increases with increasing angles of attack. In order to compensate for this it is desired to create more torque on missile 14 in the desired, or CCW, direction as the angle of attack increases while developing negligible effect at zero or low angles of attack where roll rate decay is not a problem.

Figure 2:
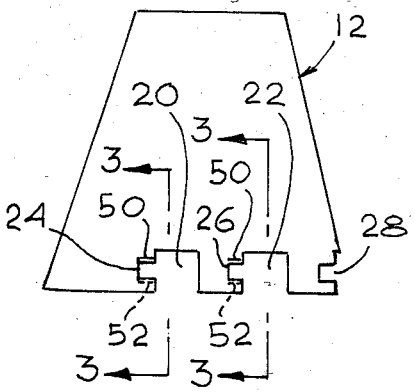
FIG. 2 is a side elevational view of a fin modified in accordance with the teachings of the present invention.
Figure 3:
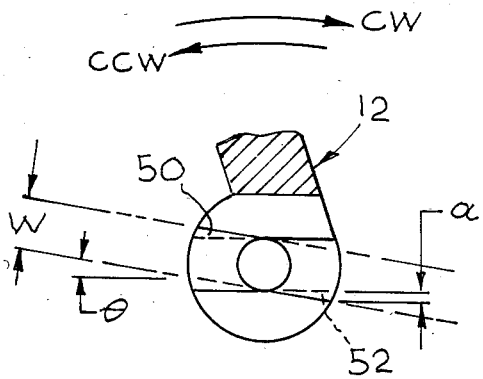
FIG. 3 is a cross-sectional view taken along lines 3—3 of FIG. 2 for more fully illustrating the novel design of the present invention.

In accordance with the teaching of the present invention, a single technique which has a minimum impact on cost, strength, flutter or aerodynamics of existing tail fin designs, has been developed. In particular, FIG. 2 shows a side elevation of the disassembled fin and shows special added cuts 50 and 52 made in the notch areas of the two forward locks to provide the novel design of the present invention. FIG. 3 is a cross-sectional view along line 3—3 of FIG. 2 looking forward from the aft portion of the missile, clearly illustrating how the two forward lock sections are modified to develop this compensation. For purposes of clarity, the view shows the lock sections without the locking teeth in engagement with the slot areas 24 and 26.

The present invention modifies the tail fin 12 so the air load on the tail will increase the cant angle when the tail fin 12 is producing CCW torque and reduce or have no effect when it is producing CW torque. This desired result is accomplished with a simple mill cut on the two forward locks of each tail fin 12 while the aft lock is not changed.

In particular, during the fabrication of each tail fin 12, additional material is milled, or otherwise removed, from diagonally opposite sides of the two forward lock sections to form wedge-shaped areas 50 and 52. The angle $\theta$ of the cut is preferably in the range from about 4° to about 6° and the maximum extent of the cut, indicated by reference letter "a", is approximately 0.005 inches, the preferred range of this cut being from about 0.004 to about 0.006 inches. The width W (in the range from about 0.08 inches to about 0.12 inches) and angle $\theta$ can be selected to give the desired change in cant angle between opposite tail fins.

When the tail fin 12 is loaded in the direction shown to produce CW torque, all three locks are loaded approximately equally, thereby locating the elastic axis of the tail lock assembly just aft of the center of pressure, thus producing a small increase in cant angle with load.

When the tail fin is loaded in the direction to produce CCW torque (i.e., when the missile is initially caused to roll in the CCW direction after launch) the aft lock will take all the torque. This moves the elastic axis aft approximately 0.60 inches which will produce a larger increase in cant angle with load (i.e., as the attack angle increases). The difference of these two changes, $\Delta$CCW - $\Delta$CW, will be the net additional torque in the CCW direction.

When the deflection at the two forward lock positions is sufficient, (approximately 0.005 inches), all three locks will pick up the load, and the tail surface will have the same stiffness as an unmodified tail.

Figure 4:
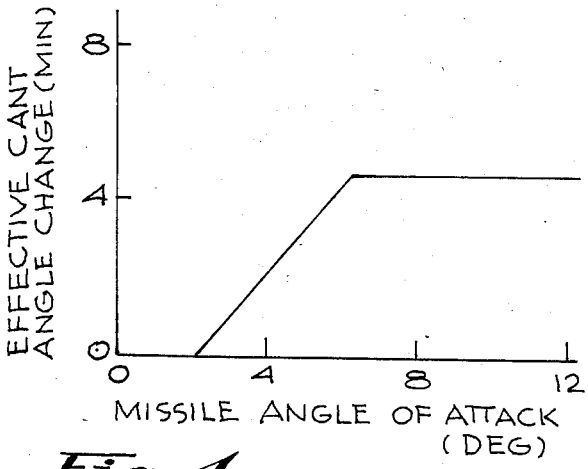
FIG. 4 is a graph illustrating the typical effect of cant angle change as a function of the missile angle of attack.

FIG. 4 is a graph illustrating the manner in which the present invention maintains the missile roll rate as the missile angle of attack increases. As shown, the effective cant angle change (the cant angle change required on all four tail fins to produce the same torque) increases substantially linearly with increasing missile angle of attack (after beginning at substantially zero) until all three locks pick up the load, at which time the effective cant angle remains constant for larger angles of attack.

Figure 5:
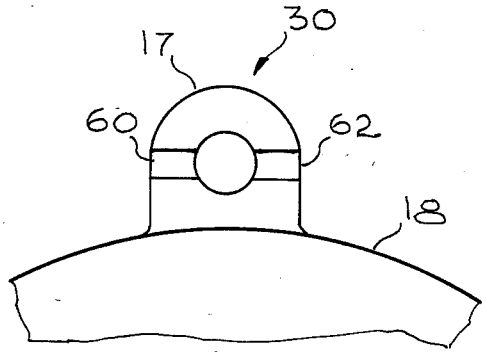
FIG. 5 is a view along line 5—5 of FIG. 1 with the fin removed, looking in the direction of the arrows.

FIG. 5 is a cross-sectional view along line 5—5 of FIG. 1 and shows a pair of locking teeth 60 and 62 on opposite sides of the central bore of hinge mechanism 30.

Although there has been described above one specific arrangement of a missile tail fin assembly in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A missile tail fin assembly for maintaining the roll rate of the missile within a predetermined range independent of variations in missile angle of attack comprising:

at least one pivotably mounted tail fin;

a fixture provided on the aft portion of said missile, said fixture including a plurality of members extending therefrom and including a key-shaped portion formed on each said member for engaging an associated fin;

a set of complementary notches formed on said fin and arranged to receive the key-shaped portions when the fin is in a predetermined angular position extending outwardly from the fixture, said notches being located at various positions along the fin forward and rearward, respectively, of a center line of the fin, at least the most rearward notch being shaped to lock the key-shaped portion received therein in a fixed angular position and the notches forward of the most rearward notch being shaped with predetermined cutout portions to permit limited torsional distortion of the fin relative to said predetermined angular position under the influence of lateral aerodynamic forces for missile flight angles of attack within a preselected range; and a hinge pin mounted on said fixture;

the fin being folded in against the fixture before launch and being directed outward after launch, said key-shaped portions being received by said fin notches and thereby locking said fin into position for limited torsional distortion.

2. The tail fin assembly as defined in claim 1 wherein the angular extent of the cutout portions is such that torsional distortion of the fin is proportional to missile angle of attack for attack angles greater than a first predetermined value and less than a second predetermined value.

3. The tail fin assembly as defined in claim 2 wherein the angular extent of the cutout portions is such that the torsional distortion of the fin is substantially constant for missile angles of attack greater than said second predetermined value.

4. The tail fin assembly as defined in claim 2 wherein said first predetermined value is approximately 2° and said second predetermined value is approximately 6°.

5. The tail fin assembly as defined in claim 1 wherein said key-shaped portions each comprise a plurality of teeth.

6. The tail fin assembly as defined in claim 1 wherein said notches are shaped by milling a wedge-shaped portion of material from opposite sides of said notch.

7. A tail fin for pivotably mounting in a missile tail fin assembly, the tail fin being engageable by locking means when in an extended operative position, comprising:

a plurality of locking members respectively positioned from front to rear along the pivot axis of the fin when mounted in the tail fin assembly, each locking member including a recess positioned to engage a mating projecting portion of a pivot support member, the locking members being spaced apart along said axis to receive correspondingly spaced pivot support members;

the recess of the most rearward locking member being configured to lock the mating projecting portion engaged therein in a fixed angular position;

said locking members forward of the most rearward locking member having their recesses selectively enlarged to develop clearances relative to said projecting portions which permit rotation of the locking member and adjacent fin portion about the pivot axis in only a preselected direction, whereby the permissible rotation of the tail fin forward of the most rearward locking member produces an increased cant angle of the fin, relative to the pivot axis, during increased angles of attack to increase the transverse aerodynamic force bearing on the fin in a predetermined direction.

8. The tail fin of claim 7 wherein each locking member includes a centrally located bore for receiving a pivot pin therein.

9. The tail fin of claim 8 wherein the recessed portion of each locking member comprises a transverse notch having a pair of cutouts disposed at 180° with respect to each other and located on opposite sides of the central bore of the member.

10. The tail fin of claim 9 wherein said notches are symmetrically shaped as mirror images of each other.

11. The tail fin of claim 7 wherein the locking member nearest the aft edge of the tail fin has a recessed portion comprising a pair of opposed planar surfaces for bearing against the protruding portion of the corresponding locking member to block rotation of the locking member in either direction when engaging said projecting portion.

12. The tail fin of claim 11 wherein each locking member forward of the aftmost locking member includes a recess having a pair of diametrically opposed, wedge-shaped notches oriented to cooperate with the pivot support members to block rotation in one direction while permitting limited rotation in the other direction to accommodate longitudinal twisting of the tail fin in order to develop rotational torque in the direction of missile roll which is proportional to missile angle of attack within a predetermined range.

* * * * *